US005351704A

United States Patent [19]

Hunnicutt, Jr. et al.

[11] Patent Number: 5,351,704

[45] Date of Patent: Oct. 4, 1994

[54] WALKING CANE FOR ILLUMINATING THE FOOTPATH OF THE USER

[75] Inventors: Willard T. Hunnicutt, Jr., Atlanta; Thomas F. Wyatt, III, Doraville, both of Ga.

[73] Assignee: American Geriatric Products, Inc., Norcross, Ga.

[21] Appl. No.: 63,510

[22] Filed: May 18, 1993

[51] Int. Cl.[5] ..... A45B 3/04

[52] U.S. Cl. ..... 135/66; 135/65; 135/75; 135/910; 362/102

[58] Field of Search ..... 135/910 O, 65, 66 OR, 135/75, 911; 362/102, 109, 114

[56] References Cited

U.S. PATENT DOCUMENTS

| | | | |
|---|---|---|---|
| D. 294,868 | 3/1988 | Sim . | |
| D. 324,134 | 2/1992 | Williams . | |
| 2,597,172 | 5/1952 | Parker | 135/910 |
| 4,099,535 | 7/1978 | Hubachek . | |
| 4,236,544 | 12/1980 | Osaka | 362/102 |
| 4,625,742 | 12/1986 | Phillips | 362/102 |
| 4,837,666 | 6/1989 | Conkle . | |
| 5,197,501 | 3/1993 | Ragatz | 135/910 |
| 5,226,718 | 7/1993 | Lin | 362/102 |

FOREIGN PATENT DOCUMENTS

| | | | |
|---|---|---|---|
| 1270457 | 4/1972 | Fed. Rep. of Germany | 135/910 |
| 2655215 | 6/1978 | Fed. Rep. of Germany | 135/910 |
| 1524955 | 4/1968 | France | 135/910 |
| 0536610 | 5/1941 | United Kingdom | 135/910 |
| 2110081 | 6/1983 | United Kingdom | 135/910 |

*Primary Examiner*—Carl D. Friedman
*Assistant Examiner*—Wynn E. Wood
*Attorney, Agent, or Firm*—Needle & Rosenberg

[57] ABSTRACT

The invention provides a lighted walking cane, having an elongated body portion with an upper end and an opposite lower end, the body portion having a translucent portion adjacent the lower end. The walking cane also includes a handle on the upper end, an illuminating means in the body portion to supply light through the translucent portion, and means on the cane for powering the illuminating means. A reflecting means disposed within the translucent portion opposite the illuminating means so as to project light in the preferred direction is also provided.

8 Claims, 4 Drawing Sheets

WALKING CANE FOR ILLUMINATING THE FOOTPATH OF THE USER

BACKGROUND OF THE INVENTION

This invention relates generally to a lighted walking cane and more particularly to a multi-function cane for lighting the users way in the dark.

The prior art includes many devices which incorporate illuminating means into umbrellas, batons, bicycle safety poles, signal lights, and the like. However, none of these devices may be used as a cane, with or without a light or physical signal beacon.

Another group of prior art inventions discloses walking canes or sticks having specific structures for providing light for use in the dark by the user. U.S. Pat. No. 4,625,742 to Phillips teaches a cane having a light-emitting portion housed within a lens positioned so that light is cast forward of the user along the ground. This cane also provides for a plurality of small apertures adjacent the light source around the remaining surface juxtaposed to the lens to provide a beacon light function. The switch is positioned below the handle.

U.S. Pat. No. 4,837,666 to Conkle provides a night light attachment for a walking cane, crutch or the like. The light is secured to the cane near the handle by the use of a clamp and is provided with a battery-operated light positioned to illuminate the surfaces upon which the user is walking.

U.S. Pat. No. 4,099,535 to Hubachek provides a walking cane for the blind having window for the emission of light so that the cane can be seen during the day or night.

SUMMARY OF THE INVENTION

The invention provides a lighted walking cane, having an elongated body portion with an upper end and an opposite lower end, the body portion having a translucent portion adjacent the lower end. The walking cane also includes a handle on the upper end, an illuminating means in the body portion to supply light through the translucent portion, and means on the cane for powering the illuminating means. A reflecting means disposed within the translucent portion opposite the illuminating means so as to project light in the preferred direction is also provided. The lighted walking cane according to the invention includes an electrical circuit connecting the powering means to the illuminating means and an on/off switch in the circuit. The powering means can comprise a battery in the circuit. The body portion includes an upper section and a lower section and means for joining the sections together; the translucent portion is in the lower section and the illuminating means is in the upper section. A portion of the upper section can be telescopically received within the lower section and secured therein. The lighted walking cane can also have joining means comprising threads on the upper end of the lower section and complimentary threads on the lower end of the upper section and means for securing the threaded lower section to the upper section.

DETAILED DESCRIPTION OF THE INVENTION

Figure 1:
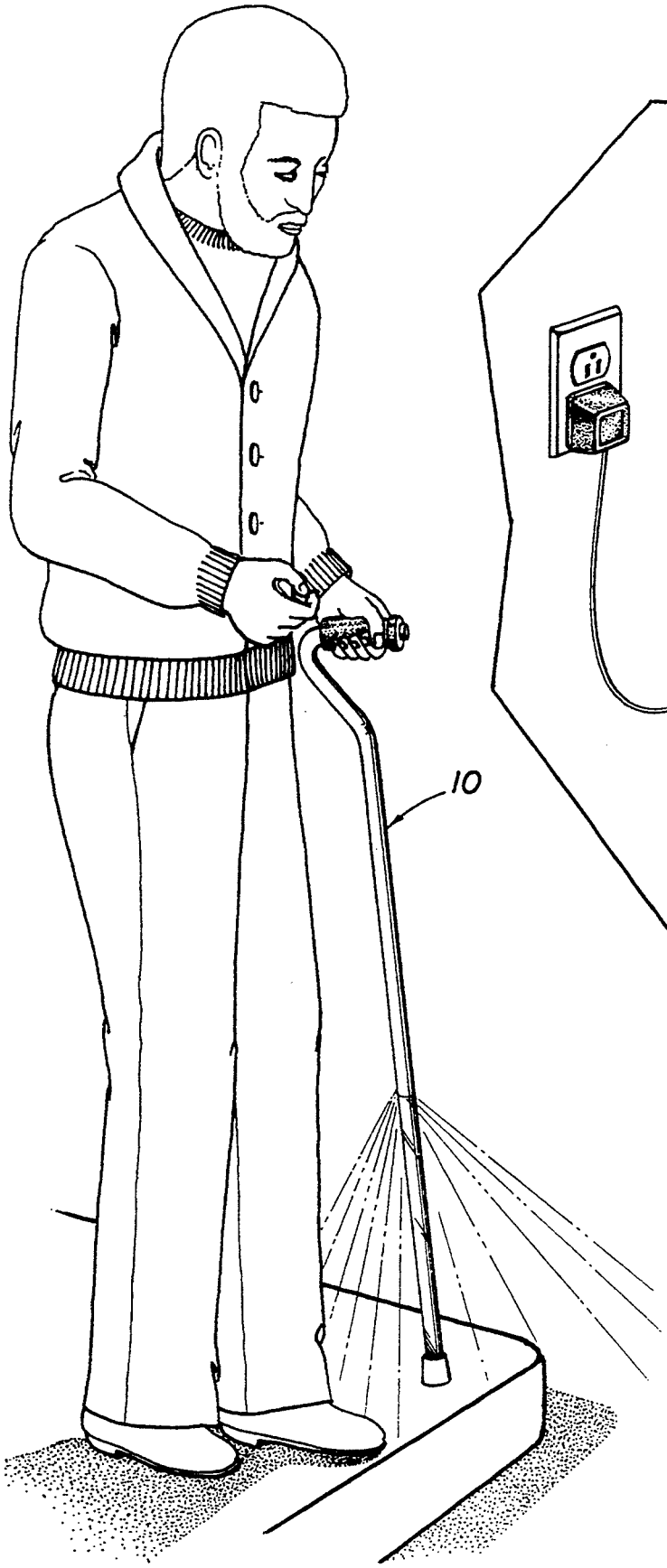
FIG. 1 shows a lighted walking cane according to the present invention.
Figure 2:
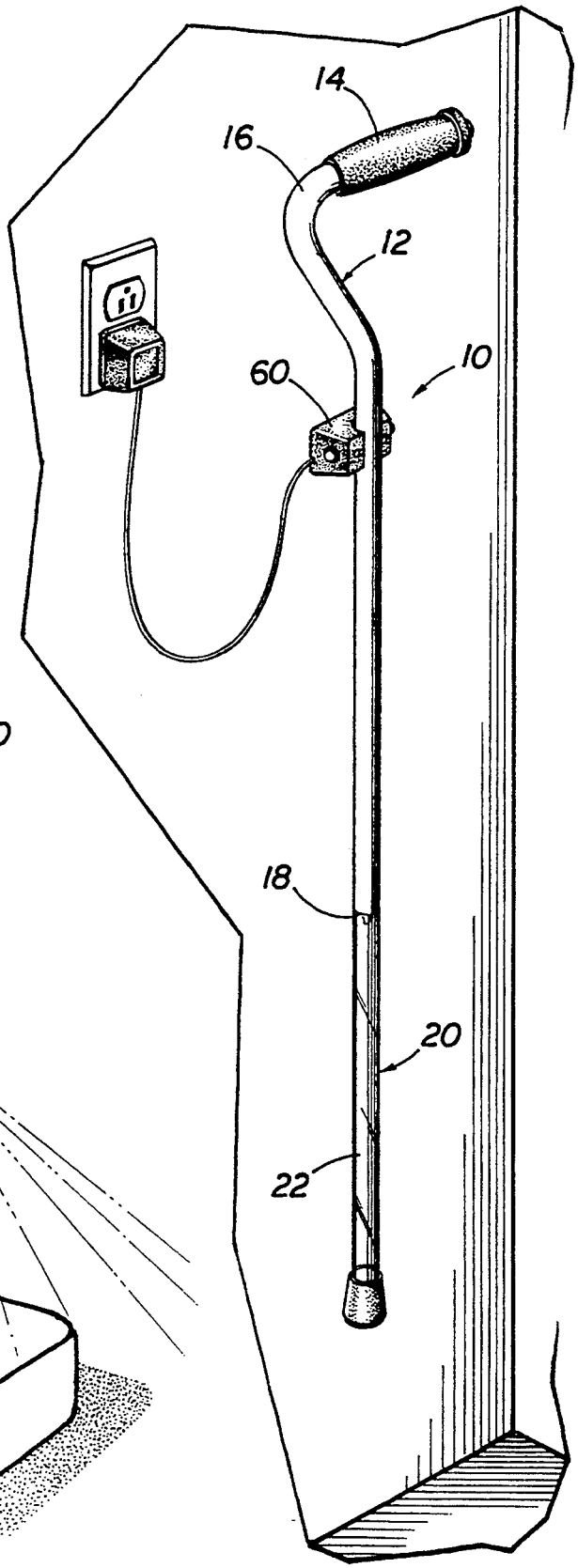
FIG. 2 shows a lighted walking cane according to the present invention mounted on a charger base.

The present invention is described by reference to the figures which show the preferred embodiments of the present invention. FIGS. 1 and 2 show the lighted walking cane 10 of the present invention in use. FIGS. 3–12 show details of the present cane 10, which comprises elongated body portion with an upper section 12 having a handle 14 at its upper end 16 and a lower end 18. The body portion of cane 10 also includes a lower section 20 comprising a translucent portion 22 joined to the upper section 12. The term "translucent" as used herein includes clear materials.

Figure 10:
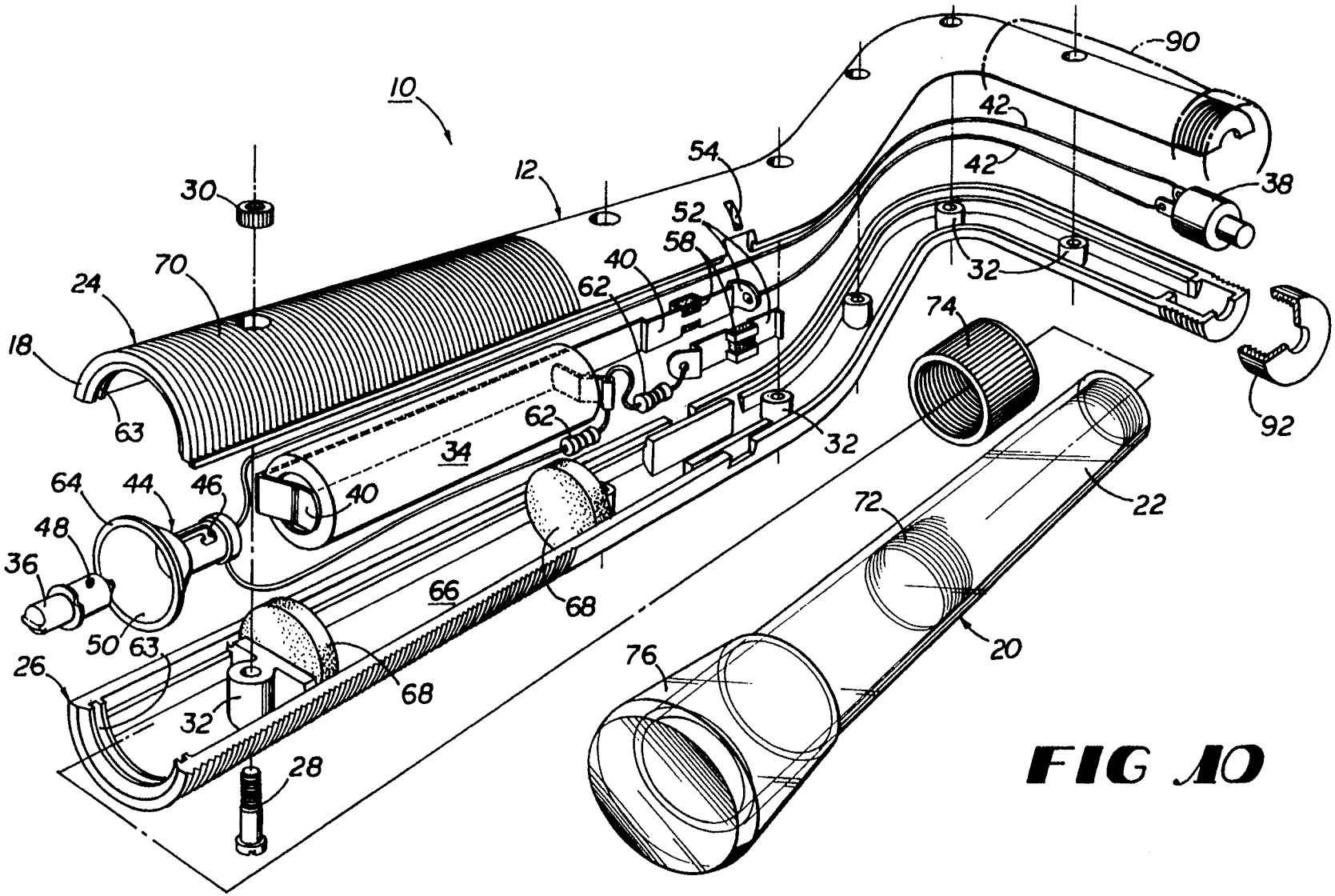
FIG. 10 shows a lighted walking cane according to the present invention having an upper section that comprises two haves.
Figure 12:
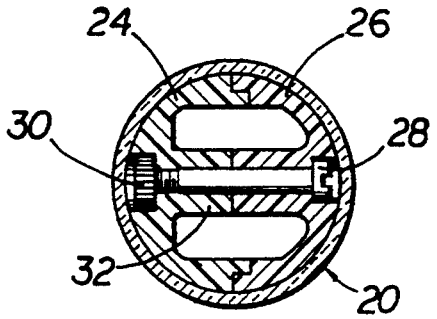
FIG. 12 is a cross sectional view of a screw and splined nut fastener holding together the two halves of the upper section of a lighted walking cane according to the present invention.

As depicted in FIGS. 10 and 12, upper section 12 comprises two halves 24 and 26, which can be aligned with each other and fastened to each other using a machine screw 28 and splined nut 30 fasteners passed through support collars 32 and secured appropriately. Although it is not expected to be necessary to disassemble the cane 10 during normal use, the two halves 24, 26 of the upper section 12 can be easily taken apart to access the electrical components of the cane for replacement or repair. Upper section 12 can be constructed of precision die cast fiber reinforced plastic, aluminum or other material possessing suitable strength and light weight nature.

Lighted walking cane 10 also includes means for powering the illuminating means, which can be a battery such as a standard zinc battery or a rechargeable, e.g., nickel cadmium battery 34.

Figure 3:
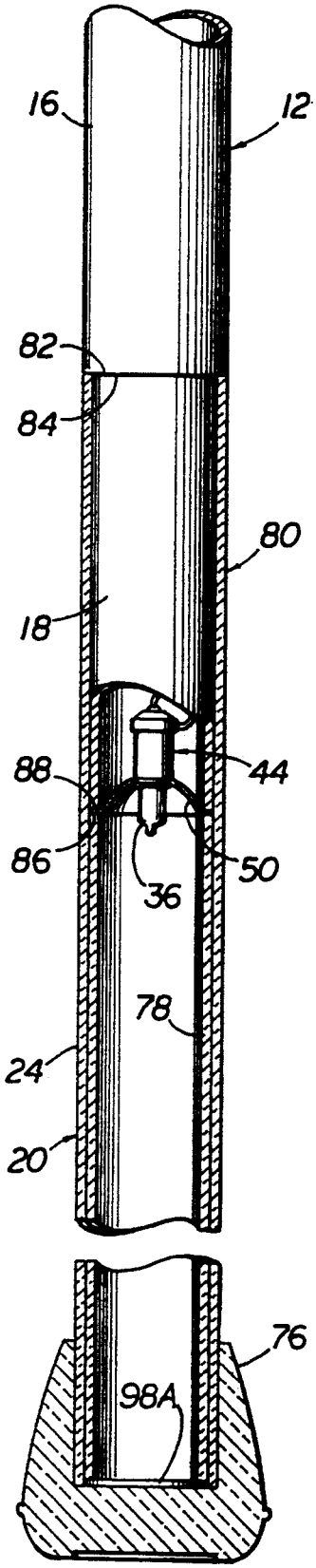
FIG. 3 shows cut-away view of the lower section of a lighted walking cane according to the present invention.
Figure 4:
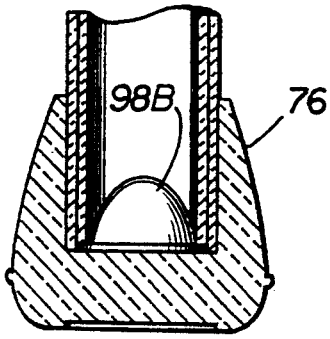
FIG. 4 shows the clear rubber tip and convex mirror of a lighted walking cane according to the present invention.
Figure 5:
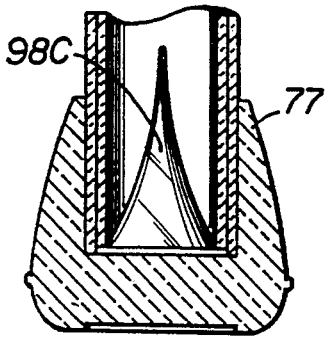
FIG. 5 shows the clear rubber tip and conical mirror with concave sides of a lighted walking cane according to the present invention.
Figure 6:
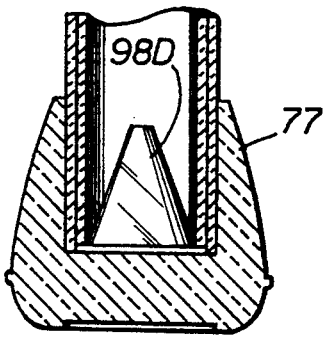
FIG. 6 shows the clear rubber tip and truncated cone mirror of a lighted walking cane according to the present invention.
Figure 7:
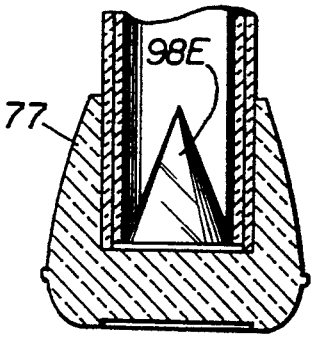
FIG. 7 shows the clear rubber tip and conical mirror of a lighted walking cane according to the present invention.
Figure 8:
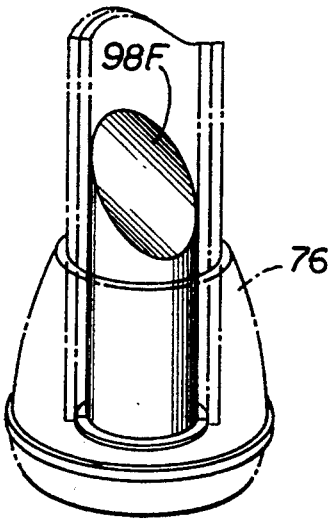
FIG. 8 shows the clear rubber tip and angle cut mirror of a lighted walking cane according to the present invention.

Means for illuminating are disposed in the body portion of cane 10 proximal to the translucent portion 22 to supply light through the translucent portion (FIGS. 3 and 10). This proximity to the translucent portion 22 insures that light emitted from the illuminating means can pass through the translucent portion 22 to light the area surrounding the base of the cane 10. The preferred illuminating means is a halogen bulb 36 selected for the intensity of the light it generates. Alternatively, the illuminating means can be an incandescent bulb, a fluorescent bulb or other source of illumination suitable for use in the present cane.

Regardless of the illuminating means selected, an electrical circuit 37 is provided for connecting the powering means to the illuminating means. The electrical circuit 37, is shown schematically in FIG. 13. FIG. 10 shows further details of electrical circuit 37, including an on/off switch 38 disposed on the cane 10 for completing and deactivating the electrical circuit. The electrical circuit includes a power source contact strip 40 which contacts the battery 34 and is connected to electrical wires 42 which connect the battery 34 to the halogen bulb 36 and to the switch 38. The contacts 40 for the power source are preferably brass and the electrical wires 42 can be any wires of suitable gauge and amperage capacity for use with the selected illuminating means.

Figure 13:
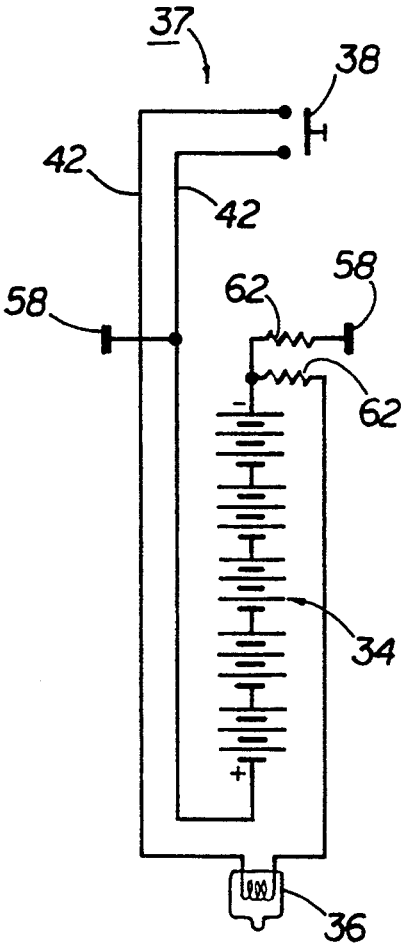
FIG. 13 shows the electrical circuit of a lighted walking cane according to the present invention.

As shown in FIGS. 10 and 13, the fixture for holding the illuminating means can be a bayonet type fixture 44 having a bayonet slot 46 for receiving a bayonet button 48 on the illuminating means such as halogen bulb 36. The fixture can include a mirrored parabolic metal reflector 50. Any other fixture for the illuminating means can be selected based on the choice of illuminating means.

As illustrated in FIGS. 10 and 2, the electrical circuit 37 can further include conductive metal charger contact clips 52 disposed within the cane proximal to blade slots 54 to mate with fins on a charger wall mount fixture 56. The electrical circuit further includes conductive metal electrical contacts 58 to the charger base 60. The charger contact clips 52 and contacts 58 are connected to the power source contact strip 40 and in this manner provide charging current to a rechargeable power source. Resistors 62 may also be a part of the electrical circuit.

Fixture 44, rechargeable battery 34, the electrical circuit and switch 38 fit within upper section 12 of the lighted walking cane 10. The open ended lower end 18 of the upper section 12 can include an annular slot 63 to mount the annular rim 64 of the reflector type fixture 44. Above fixture 44, upper section 12 can include a chamber 66 for containing the power source. At the upper and lower ends of chamber 66 are positioned foam rubber cushions 68 for securing the power source, as depicted in FIG. 10.

Figure 11:
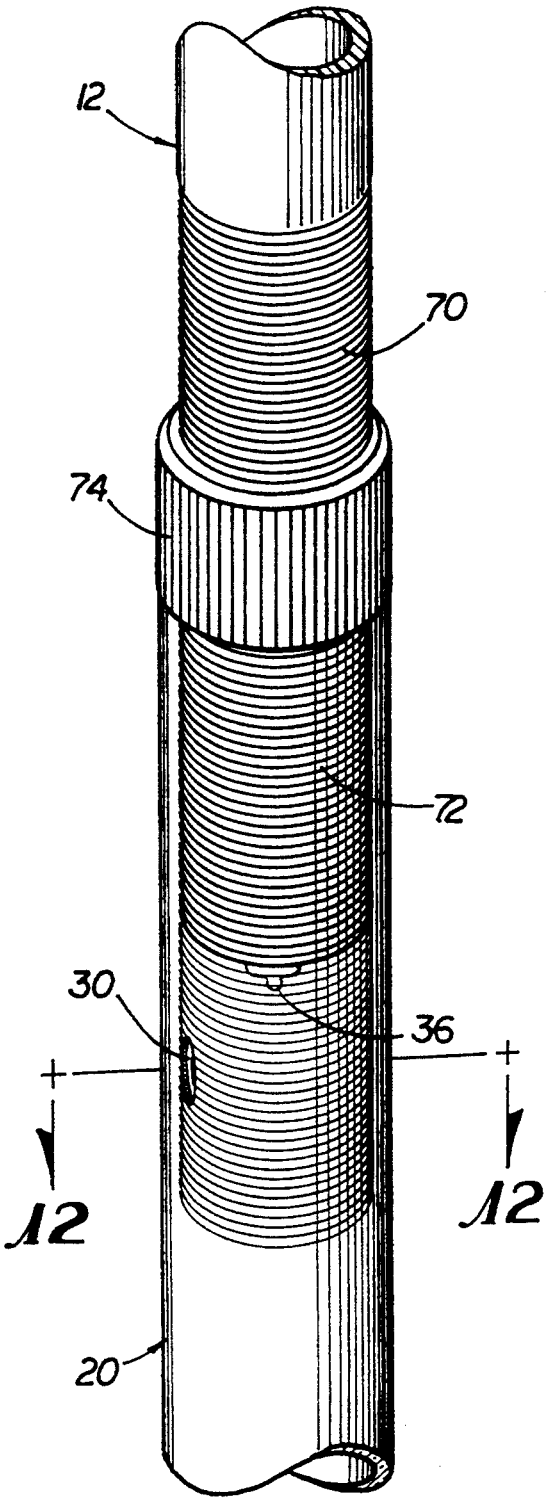
FIG. 11 shows the internal threads and locknut of a lighted walking cane according to the present invention.

The lighted walking cane 10 depicted in FIG. 10 further includes means for joining upper section 12 to lower section 20. The joining means can comprise external threads 70 on the lower end of upper section 12 and internal threads 72 formed on the inner surface of the translucent portion 22, the internal threads 72 and external threads 70 being complimentary to each other. Joining means can further comprise a lock nut 74 for securing the position of upper section 12 relative to lower section 20. The structural relationship between internal threads 72 and lock nut 74 of the joining means in adjusting the height of the cane is shown in FIG. 11.

Figure 9:
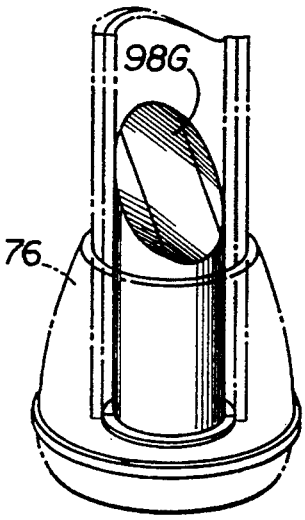
FIG. 9 shows the clear rubber tip and faceted angle cut mirror of a lighted walking cane according to the present invention.

Translucent portion 22 of lower section 20 can be constructed of a clear LEXAN TM tube having internal threads on the upper end thereof. Lower section 20 can further comprise a clear rubber tip 76 on the lower end of translucent portion 22. Also disposed in the lower end of translucent portion 22 is a reflecting means positioned opposite bulb 36 or other illuminating means so as to project light in the preferred direction (FIGS. 3–9). The reflecting means can be a mirror selected from a variety of shapes including flat 98A (FIG. 3), convex 98B (FIG. 4), conical 98E (FIG. 7), truncated cone 98D (FIG. 6), conical with concave sides 98C (FIG. 5), angle cut 98F (FIG. 8) and faceted angle cut 98G (FIG. 9).

FIG. 3 depicts an alternative means for joining the upper and lower sections of the cane 10, wherein a portion of the upper section is telescopically received within the lower section and secured therein. In this embodiment, the translucent portion 22 comprises concentric inner and an outer tubular members 78, 80, the inner tubular member 78 being capable of being telescopically received within the outer member 80. The upper section 12 also has a step 82 formed by a difference in the outer diameter of the upper end 16 of upper section 12 and the outer diameter of the lower end 18 of the upper section 12. The lower end 18 of the upper section 12 has an outer diameter capable of being telescopically received within the outer tubular member 80 of the lower section 20. In this manner, outer tubular member 80 slides over the lower end 18 of upper section 12 so that the upper edge 84 of the outer tubular member 80 abuts step 82, which prevents it from sliding further. Means for securing the upper section 12 in the lower section 20 include glues, other adhesives or means suitable for securing the particular materials of the sections to be joined.

The upper edge 86 of the inner tubular member 78 abuts the bottom edge 88 of the lower end 18 of the upper section 12. The inner tubular member 78 has substantially the same diameter as the bottom edge 88 of the open ended lower end 18 of the upper section 12. In this manner, the inner tubular member 78 is held in alignment with the bottom edge 88 by the outer tubular member 80.

The embodiment depicted in FIG. 3 is also adjustable, simply by cutting off the lower end of the translucent portion 22, both the inner and outer tubular members 78 and 80, to the desired length. After cutting the translucent portion 22 to the correct length, the rubber tip 76 can simply be replaced and the cane 10 is ready to use.

As shown in FIG. 10, handle 14 of upper section 12 can include a closed cell foam grip 90 glued to the handle 14. The end of handle 14 can include a threaded end cap 92 with an opening therein through which the push button on/off switch extends.

In addition to the embodiments depicted, the present cane 10 can be fitted with a four legged base to provide a walker-type cane. The walker-type lighted walking cane can be adjustable by either of the means described above. Instead of having a simple rubber tip at the lower end of the translucent portion 22, the walker-type cane has a four legged base attached thereto to permit the cane to stand by itself.

Although the present invention has been described with reference to specific details of certain embodiments thereof, it is not intended that such details should be regarded as limitations upon the scope of the invention.

What is claimed is:

1. A walking cane for illuminating the footpath of the user, comprising:

(a) an elongated body portion having an upper section having an upper end and an opposite lower end, the upper section containing fiber reinforced plastic and comprising two lengthwise halves which are aligned with each other and fastened to each other, a lower section and means for joining the sections together, the body portion having a translucent portion containing clear polycarbonate, wherein the translucent portion is in the lower section and wherein the translucent portion extends through the entire perimeter of the body portion;

(b) a handle on the upper end;

(c) an illuminating means in the body portion to supply light through the translucent portion, wherein the illuminating means is in the upper section;

(d) means on the cane for powering the illuminating means; and (e) reflecting means disposed opposite the illuminating means within the translucent portion so as to direct light onto the footpath of the user.

2. The lighted walking cane according to claim 1, further comprising an electrical circuit connecting the powering means to the illuminating means and an on/-off switch in the circuit.

3. The lighted walking cane according to claim 2, wherein the powering means comprises a battery in the circuit.

4. The lighted walking cane according to claim 1, wherein a portion of the upper section is telescopically received within the lower section and secured therein.

5. The lighted walking cane according to claim 1, wherein the joining means comprises threads on the upper end of the lower section and complimentary threads on the lower end of the upper section and means for securing the threaded lower section to the upper section.

6. The lighted walking cane according to claim 5, wherein the threads on the lower section are formed on the inner surface of the translucent portion.

7. The lighted walking cane according to claim 1 wherein the translucent portion comprises concentric inner and outer tubular members, the inner tubular member being capable of being telescopically received within the outer tubular member.

8. A walking cane for illuminating the footpath of the user, comprising:

(a) an elongated body portion having an upper section comprising an upper end and a lower end, a step formed by a difference in the outer diameter of the upper end and the outer diameter of the lower end;

a lower section having a translucent portion therein; and means for joining the sections together;

(b) a handle on the upper end;

(c) an illuminating means in the body portion to supply light through the translucent portion in the lower section;

(d) means on the cane for powering the illuminating means, wherein the illuminating means is in the upper section;

(e) reflecting means disposed in the translucent portion opposite the illuminating means so as to project light in the preferred direction; and wherein the translucent portion comprises concentric inner and outer tubular members, the inner tubular member being capable of being telescopically received within the outer member, the lower end of the upper section having an outer diameter capable of being telescopically received within the outer tubular member of the translucent portion, the outer tubular member having an upper edge dimensioned to slide over the lower end of the upper section so that the upper edge abuts the step which prevents it from sliding further.

* * * * *